US005629509A

United States Patent [19]

Uebel

[11] Patent Number: 5,629,509

[45] Date of Patent: May 13, 1997

[54] AXLE COUNTER WITH VARIABLE THRESHOLD SETTING

[75] Inventor: Helmut Uebel, Leonberg, Germany

[73] Assignee: Alcatel Sel Aktiengesellschaft, Stuttgart, Germany

[21] Appl. No.: 390,558

[22] Filed: Feb. 17, 1995

[30] Foreign Application Priority Data

Feb. 17, 1994 [DE] Germany ..... 44 05 039.9

[51] Int. Cl.[6] ..... G06M 7/00

[52] U.S. Cl. ..... 235/98 C; 73/520.01; 235/91 M

[58] Field of Search ..... 235/91 M, 98 C; 73/520

[56] References Cited

U.S. PATENT DOCUMENTS

| | | | |
|---|---|---|---|
| 3,748,443 | 7/1973 | Kroll et al. | 235/99 A |
| 3,779,086 | 12/1973 | Myrent et al. | 73/490 |
| 5,069,624 | 12/1991 | Hautvast et al. | 235/95 B X |

FOREIGN PATENT DOCUMENTS 3218541 11/1983 Germany .

OTHER PUBLICATIONS

Signal + Draht, 77 (1985), No. 4, p. 72 et seq., Neue Zahlpunkte (Zp30) fur Achszahler, Hoffmann & Uebel.

Signal + Draht, 78 (1986), No. 12, p. 264 et seq. Das Radsensorsystem RS S als Zugeinwirkungspunkt, Hoffmann & Sander.

*Primary Examiner*—Patrick J. Stanzione

*Attorney, Agent, or Firm*—Frishauf, Holtz, Goodman, Langer & Chick

[57] ABSTRACT

An axle counter which compares axle passage pulses generated in an electromagnetic rail contact with a predetermined threshold value and, when this threshold value is exceeded, feeds an axle counter pulse to presence-of-trains indicating equipment, is equipped with overwritable memories (SMA, SMI) for storing this threshold value. In response to a setup command entered manually by depressing a key or transferred from a distant control facility (STW), the memories can be overwritten with a current axle passage pulse value or a statistically determined value corresponding to an average axle passage pulse. This eliminates the need to reposition the rail contact at regular intervals and permits this repositioning to be replaced by an adaptation of the threshold value to the axle passage pulses, which change as a result of rail wear, for example.

5 Claims, 2 Drawing Sheets

AXLE COUNTER WITH VARIABLE THRESHOLD SETTING

The present invention relates to an axle counter as set forth in the preamble of claim 1.

BACKGROUND OF THE INVENTION

Such electromagnetic axle counters are used to indicate track occupancy or nonoccupancy in railway systems. Recent designs are described, for example, in articles published in "Signal+Draht" 77 (1985), No. 4, pages 72 et seq., and in "Signal+Draht" 78 (1986), No. 12, pages 264 et seq.

In all known designs of electromagnetic axle counters, the tires and/or flanges of the vehicle wheels act on an electromagnetic field which is generated by a transmitting coil in a transmitting head of a rail-mounted sensor portion of the axle counter and received by a receiving coil in a receiving head of the sensor portion, which is located a few centimeters from the transmitting head. The sensor portion, consisting of transmitting head and receiving head, including the transmitter feeding the transmitting coil and the receiver picking up the signal induced in the receiving coil, is also referred to as "electromagnetic rail contact".

The signal change sensed by the receiving coil upon passage of a wheel depends on predetermined parameters, but also on quantities which vary with time and necessitate regular readjustments of the rail contact.

The latter applies particularly to rail wear, as a result of which the flanges of passing wheels move along a lower path and, thus, closer to the transmitting head and receiving head and influence the electromagnetic field more strongly, which leads to receiver output signals of changed shape and duration.

In conventional axle counters, the changes caused by rail wear are compensated for by repositioning the transmitting head so that, when the rail contact is influenced by a master gage simulating a standard wheel, predetermined receiver output signals will be measured.

SUMMARY OF THE INVENTION

It is the object of the invention to provide an axle counter which eliminates the need to reposition the transmitting head for the aforementioned purpose.

This object is attained by the features of claim 1.

With the aid of the teaching of claim 1, the threshold value required to evaluate the receiver output signals can be changed and replaced by a new threshold value derived, for example, from a current action on the rail contact. Thus, instead of adjusting the transmitting head, the threshold value can be changed to ensure reception and detection of the axle passage signals, which are changed as a result of rail wear, for example. The mounting can remain unchanged.

A new threshold value can be derived, for example, from a single measurement performed with the aid of a standard wheel, or it may be obtained by statistically evaluating axle passages observed over a prolonged period of time.

Further advantageous features of the axle counter according to the invention are defined in the subclaims.

Claims 2 and 3 relate to the origin of the setup command. A setup command can be entered manually on the spot, e.g., during routine maintenance of the rail contact, or initiated, possible automatically, from a monitoring device located in an interlocking station or in a similar higher-level control station.

The subject matter of claim 4 is a monitoring device which is capable of carrying out statistical evaluations and delivering a setup signal.

Claim 5 relates to an embodiment of an evaluating circuit.

One embodiment of the axle counter according to the invention will now be described with reference to the accompanying drawing, in which:

DETAILED DESCRIPTION OF THE INVENTION

Figure 1:
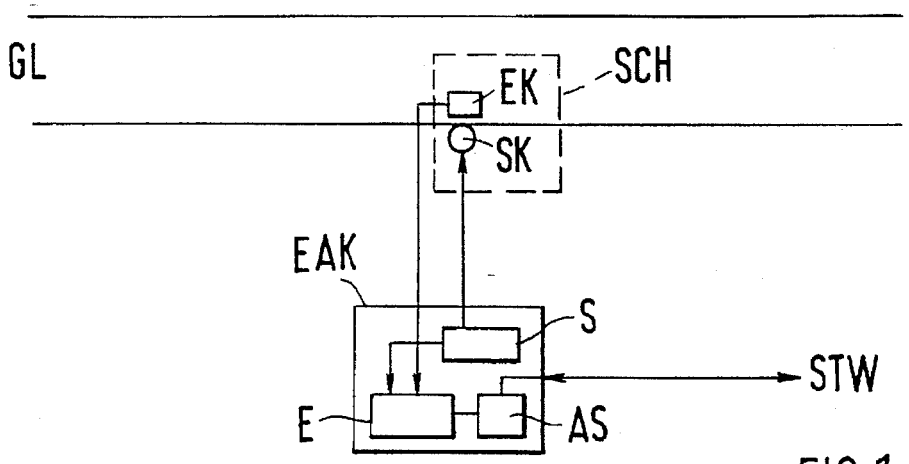
FIG. 1 shows schematically the trackside portions of an axle counter.

Referring to FIG. 1, there is shown a rail contact SCH mounted to the rail of a track GL of a railway system and having a transmitting head SK and a receiving head EK. Associated transmitter and receiver circuits S and E, respectively are housed, together with an evaluating circuit AS, in an electronic connection box EAK located a few meters from the track.

These parts, together with subcircuits (not shown) commonly contained in an interlocking station STW, form an axle counter. The trackside portions of the axle counter, i.e., rail contact and electronic connection box, are connected to the interlocking station via a data link and supply count pulses of predetermined shape and amplitude, which are initiated by wheels passing the rail contact, to the interlocking station or to any higher-level control facility that may be present instead of the interlocking station. For simplicity, only one rail contact is illustrated in FIG. 1. Rail contacts are commonly arranged in pairs and slightly displaced in relation to one another, so that besides the presence of a wheel, the direction of passage of the wheel can be determined, which is not possible with a single rail contact.

Transmitting head SK and receiving head EK of the rail contact SCH are connected to the electronic connection box EAK by separate lines. The transmitter circuit S in the electronic connection box serves to energize a transmitting coil contained in the transmitting head, and the receiver circuit E is designed to amplify the signal induced in the receiving head and convert it, according to its amplitude and/or phase (as a reference with respect to the transmitted signal), to an analog output signal representative of the wheel position during passage through the rail contact. The evaluating circuit AS in the electronic connection box compares the analog signal from the receiver circuit with a threshold value and, if the signal has a sufficient amplitude and duration, converts it into a count pulse for the interlocking station.

In conventional axle counters, the threshold value is a fixed voltage which is preset and never changed. Since a change in the receiver output signal with time, e.g., due to rail wear, is unavoidable, the rail contact in such axle counters must, from time to time, be repositioned until the receiver output signal corresponds to the originally provided signal.

Figure 2:
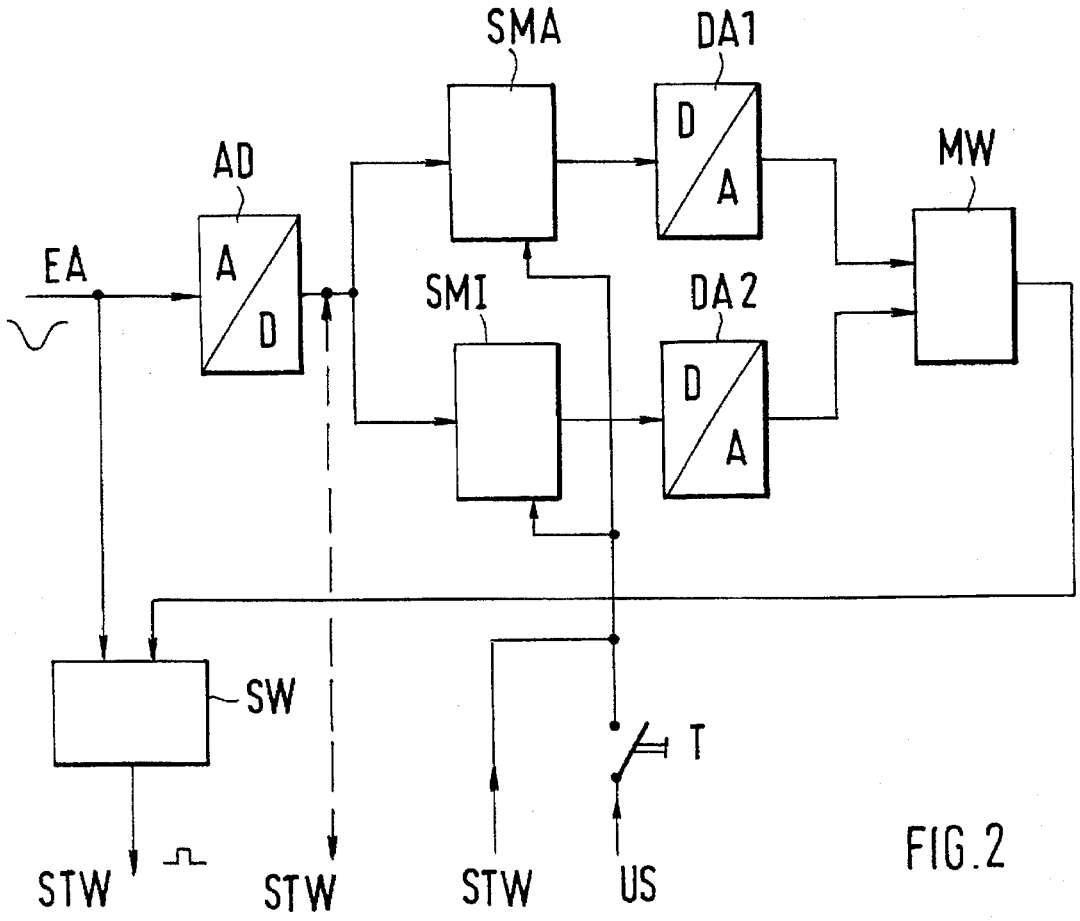
FIG. 2 shows an evaluating circuit.

In the axle counter according to the invention, the evaluating circuit AS, shown in FIG. 2, includes overwritable memories SMA, SMI for storing the threshold value, which allow the entered threshold value to be replaced by a new threshold value.

The output value of an A/D converter AD at the input end, which is fed with the analog signal appearing at the receiver output EA, will be stored as a new threshold value, for example, if the memories SMA and SMI are enabled by application of a control potential US by means of a key contact T or by application of a control potential from the interlocking station STW.

In FIG. 2, separate memories, the memories SMA and SMI, are provided for the maximum value and minimum value of the signal to be stored. The threshold value, which is compared with the received analog signal in a threshold circuit SW, must be generated continuously via two D/A converters DA1, DA2 and an averaging circuit MW.

It is also possible, of course, to perform the averaging prior to the storage and to store the average value. The output signal of the A/D converter AD may be replaced by a threshold value transmitted by the interlocking station, as is indicated by the broken line from the output of the A/D converter to the interlocking station STW, which is shown in FIG. 3.

Figure 3:
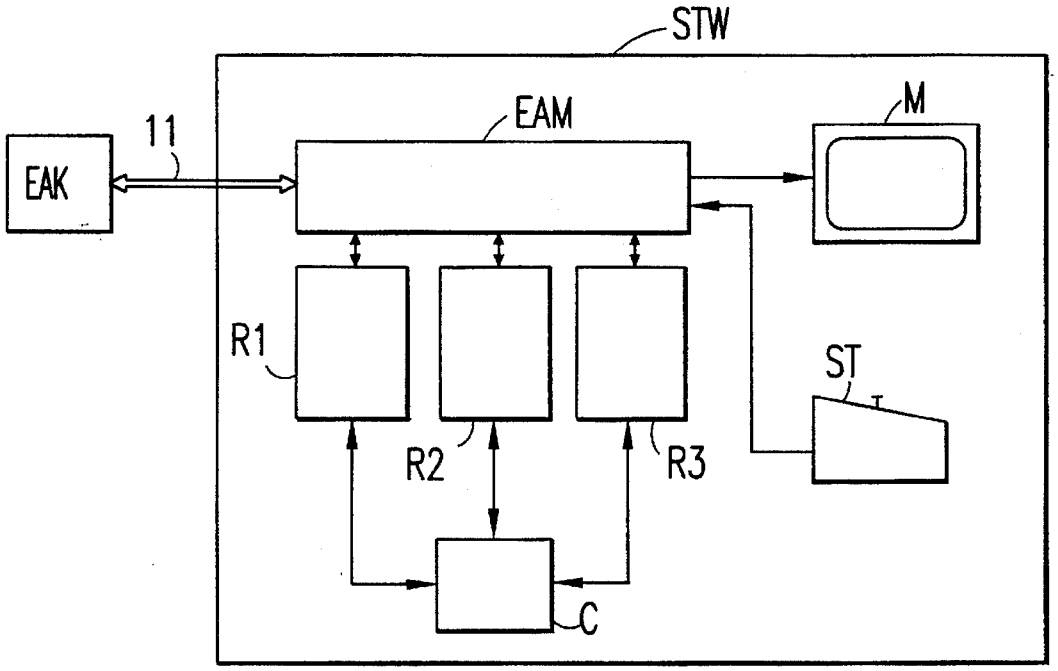
FIG. 3 shows details of the interlocking station STW.

One embodiment of the interlocking station STW is shown in FIG. 3. The interlocking station contains a three-computer system R1, R2 and R3. The results produced by the computers are compared by a comparator C. Status signals from the outdoor installation EAK are transferred into the computer system, via data links 11, and control signals are sent to the outdoor installation EAK via an input-output module EAM. A monitor M, which is also connected to the computer system via the input-output module EAM, displays the current status of the interlocking area. An input unit ST enables an operator to enter control commands.

If it is found—during routine maintenance of an axle counter, for example—that, when the rail contact is acted on by a gage corresponding to a standard wheel, the receiver circuit does not provide a signal as prescribed, transfer of the extreme values of the digitized signal produced by the standard wheel into the memories SMA and SMI can be initiated by depressing the key T, thus setting a new threshold value which takes into account the change in the receiver output signal caused, for example, by rail wear. The need for time-consuming repositioning of the rail contact is eliminated.

The discrete arrangement illustrated in FIG. 2 can also be implemented with a computer. This will be particularly advantageous if remote setting from a higher-level control station, such as an interlocking station, is provided for. Then the computer can also be used for the data exchange with the control station.

I claim:

1. An axle counter comprising at least one electromagnetic rail contact (SCH), which is attached to the rail of a track (GL) and comprises a transmitter (S, SK) generating an alternating electromagnetic field and at least one receiver (E, EK) detecting the alternating electromagnetic field, and an evaluating circuit (AS) which senses in the output of the receiver (E) a change in the alternating electromagnetic field caused by a wheel passing on the rail, compares said change with a predetermined threshold value, and, when it exceeds the threshold value, interprets it as an axle passage and feeds a count pulse to presence-of-trains indicating equipment, characterized in that an overwritable memory (SMA, SMI) is provided for storing the predetermined threshold value or values from which the predetermined threshold value can be calculated at any time, that enabling means are provided which permit the contents of the memory to be overwritten in response to a special setup command, and that further means (AD) are provided which determine a new predetermined threshold value, or values required to calculate a new predetermined threshold value, from a receiver output signal obtained under standard conditions or from changes in receiver output signals obtained over a prolonged period of time, and feed said value or values to the memory.

2. An axle counter as claimed in claim 1, characterized in that the setup command can be entered through an in-situ device (T).

3. An axle counter as claimed in claim 1, characterized in that the setup command is output by a monitoring device located in an interlocking station (STW) and connected to the axle counter.

4. An axle counter as claimed in claim 3, characterized in that the monitoring device in the interlocking station (STW) includes a computer to which characteristic features of the receiver output signals generated by axles passing the respective rail contact are fed over a prolonged period of time for statistical evaluation, and which delivers both a new threshold value and a setup signal over a data link to the rail contact (SCH).

5. An axle counter as claimed in claim 1, characterized in that the evaluating circuit (AS) comprises an A/D converter (AD) at the input end, memories (SMA, SMI) succeeding the A/D converter for storing the maximum and minimum values of the digital receiver output signal, and an averaging circuit (MW) succeeding the memories and having its output connected to a reference-voltage input of a comparator (SW) whose other input is fed with the receiver output voltage, and that a D/A converter (DA1, DA2) is provided between the output of each of the memories and a respective input of the averaging circuit.

* * * * *